US008848941B2

(12) United States Patent
Chihara et al.

(10) Patent No.: US 8,848,941 B2
(45) Date of Patent: Sep. 30, 2014

(54) INFORMATION PROCESSING APPARATUS, INFORMATION PROCESSING METHOD, AND PROGRAM

(75) Inventors: Shuichi Chihara, Kanagawa (JP); Yijun Liu, Tokyo (JP)

(73) Assignee: Sony Corporation, Tokyo (JP)

( * ) Notice: Subject to any disclaimer, the term of this patent is extended or adjusted under 35 U.S.C. 154(b) by 455 days.

(21) Appl. No.: 12/875,761

(22) Filed: Sep. 3, 2010

(65) Prior Publication Data

US 2011/0075858 A1 Mar. 31, 2011

(30) Foreign Application Priority Data

Sep. 9, 2009 (JP) ..... P2009-207985

(51) Int. Cl.

| | |
|---|---|
| ***H04R 3/00*** | (2006.01) |
| *H04R 1/10* | (2006.01) |
| *H04R 1/40* | (2006.01) |
| *G10L 21/0216* | (2013.01) |
| *H04R 29/00* | (2006.01) |
| *H04R 5/033* | (2006.01) |

(52) U.S. Cl.

CPC ..... *H04R 3/005* (2013.01); *H04R 2430/03* (2013.01); *H04R 2430/25* (2013.01); *H04R 1/406* (2013.01); *G10L 2021/02166* (2013.01); *H04R 2420/07* (2013.01); *H04R 2430/20* (2013.01); *H04R 29/008* (2013.01); *H04R 1/1083* (2013.01); *H04R 2430/01* (2013.01); *H04R 5/033* (2013.01)

USPC ..... 381/92; 381/74

(58) Field of Classification Search

USPC ..... 381/92, 71.8, 58, 74, 91, 94.1–94.9, 381/111; 367/119; 348/734; 704/226

See application file for complete search history.

(56) References Cited

U.S. PATENT DOCUMENTS

| | | | | |
|---|---|---|---|---|
| 5,276,740 | A | 1/1994 | Inanaga et al. | |
| 5,471,538 | A | 11/1995 | Sasaki et al. | |
| 2008/0129888 | A1* | 6/2008 | Zuo et al. | 348/734 |
| 2008/0187148 | A1 | 8/2008 | Itabashi et al. | |
| 2008/0232603 | A1* | 9/2008 | Soulodre | 381/63 |
| 2009/0240495 | A1* | 9/2009 | Ramakrishnan et al. | 704/226 |
| 2009/0252355 | A1* | 10/2009 | Mao | 381/309 |
| 2010/0103776 | A1* | 4/2010 | Chan | 367/119 |
| 2010/0323652 | A1* | 12/2010 | Visser et al. | 455/232.1 |

FOREIGN PATENT DOCUMENTS

| | | |
|---|---|---|
| JP | 3-96199 | 4/1991 |
| JP | 3-214892 | 9/1991 |
| JP | 5-316587 | 11/1993 |
| JP | 6-75591 | 3/1994 |
| JP | 6-233388 | 8/1994 |
| JP | 8-79897 | 3/1996 |
| JP | 2008-193420 | 8/2008 |

* cited by examiner

*Primary Examiner* — Vivian Chin
*Assistant Examiner* — Ammar Hamid
(74) *Attorney, Agent, or Firm* — Oblon, Spivak, McClelland, Maier & Neustadt, L.L.P.

(57) ABSTRACT

There is provided an information processing apparatus including microphones, a parameter setting unit, and an audio signal processing unit. At least one pair of the microphones are provided, and the microphone picks up external audio to convert the external audio into an audio signal. The parameter setting unit sets a processing parameter specifying at least the sensitivity of the microphone according to at least an instruction from a user. Based on the processing parameter, the audio signal processing unit applies processing, including beamforming processing, to the audio signal input from the microphone.

12 Claims, 10 Drawing Sheets

INFORMATION PROCESSING APPARATUS, INFORMATION PROCESSING METHOD, AND PROGRAM

BACKGROUND OF THE INVENTION

1. Field of the Invention

The present invention relates to an information processing apparatus, an information processing method, and a program.

2. Description of the Related Art

In an audio processing system such as an IP telephone system and a conference system using VoIP (Voice over Internet Protocol), beamforming is sometimes used for inputting transmitted audio to be transmitted to remote locations. In this case, a microphone array corresponding to the beamforming is used, and audio from a specified direction is selectively input as the transmitted audio. According to this constitution, while a speaker and audio from an audio source existing on the same line as the speaker (the audio is hereinafter also referred to as a "specific audio") are maintained, audio from an unspecific audio source, which is an environmental sound (noise), (the audio is hereinafter also referred to as an "unspecific audio") is reduced, whereby the transmitted audio can be input in good condition.

[Patent Document 1] Japanese Patent Application Laid-Open No. 6-233388

SUMMARY OF THE INVENTION

In the beamforming, audio picked up by each microphone of the microphone array is processed based on a phase difference between audios, a volume difference, and the like. Thus, the quality of the transmitted audio is affected by various processing parameters such as a difference in sensitivity balance between microphones, variation in sensitivity itself of each microphone, and a frequency range of input audio.

However, in the related art, when the processing parameters are changed, circuit adjustment and the like should be performed, and therefore, it is difficult for users to set the processing parameters according to a usage environment and enhance the quality of the transmitted audio.

In light of the foregoing, it is desirable to provide an information processing apparatus, which can enhance the quality of transmitted audio input using beamforming, an information processing method, and a program.

According to an embodiment of the present invention, there is provide an information processing apparatus including a pick-up unit which is provided as at least a pair and picks up external audio to convert the external audio into an audio signal a parameter setting unit which sets a processing parameter specifying at least the sensitivity of the pick-up unit according to at least an instruction from a user; and an audio signal processing unit which applies processing including beamforming processing to the audio signal, input from the pick-up unit, based on the processing parameter.

According to the above constitution, audio processing including beamforming processing is applied to an external audio signal, picked up by at least a pair of pick-up units, based on a processing parameter specifying at least the sensitivity of the pick-up unit and set according to at least an instruction from a user. According to this constitution, the processing parameter specifying at least the sensitivity of the pick-up unit is set according to a usage environment, whereby specific audio can be selectively input in good condition, and the quality of transmitted audio can be enhanced.

According to another embodiment of the present invention, there is provide an information processing method, comprising the steps of setting a processing parameter specifying the sensitivity of a pick-up unit, which is provided as at least a pair and picks up external audio to convert the external audio into an audio signal, according to at least an instruction from a user; and applying audio processing, including beamforming processing, to the audio signal based on the processing parameter.

According to another embodiment of the present invention, there is provided a program for causing a computer to execute the above information processing method. The program may be provided using a computer-readable recording medium or may be provided through communication means.

According to the present invention, there can be provided an information processing apparatus, which can enhance the quality of transmitted audio input using beamforming, an information processing method, and a program.

DETAILED DESCRIPTION OF THE EMBODIMENT

Figure 1:
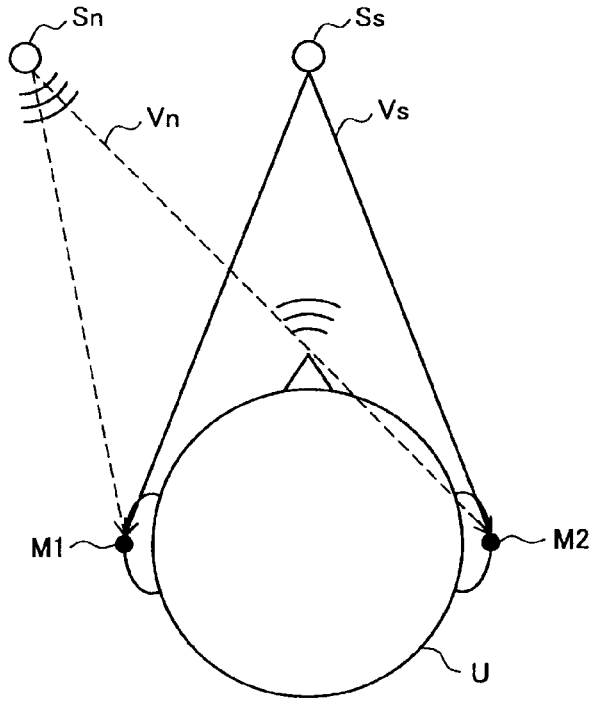
FIG. 1 is a view showing the principle of beamforming.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

[1. Beamforming]

Figure 2:
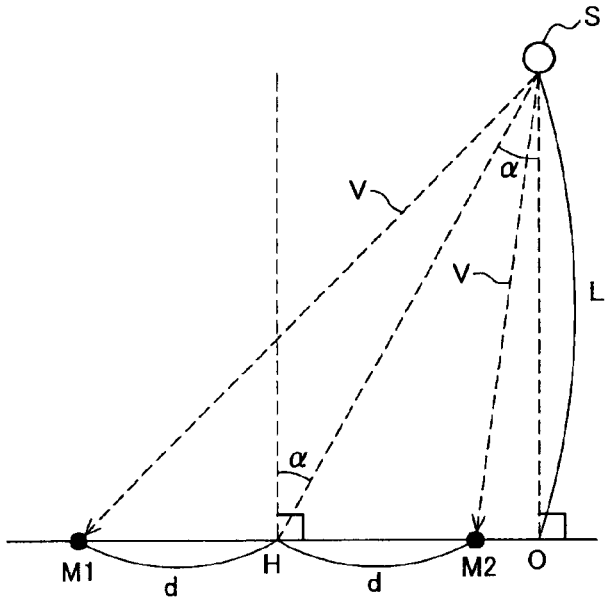
FIG. 2 is a view showing a method of calculating a phase difference between audios used in the beamforming.

First, a principle of beamforming will be described with reference to FIGS. 1 and 2. FIG. 1 is a view showing the principle of the beamforming. FIG. 2 is a view showing a method of calculating a phase difference $\Delta\theta$ between audios used in the beamforming.

FIG. 1 shows a case where left and right units of a headphone HP worn by a speaker U is provided with a pair of omnidirectional microphones M1 and M2 constituting a microphone array. The omnidirectional microphones M1 and M2 may be mounted in not only the headphone HP but also, for example, left and right units of a headband or the left and right sides of a hat. Further, two or more omnidirectional microphones may be provided.

When the speaker U speaks in a state of wearing the headphone HP, the mouth of the speaker U located at substantially equal distances from the microphones M1 and M2 is a specific audio source Ss, and a voice from the speaker U (a specific audio Vs) is picked up by the microphones M1 and M2 substantially simultaneously with substantially the same volume and substantially the same phase difference. Meanwhile, since an environmental sound (unspecific audio Vn) such as noise is generally generated from an unspecific audio source Sn located at different distances from the microphones M1 and M2, the environmental sound is picked up by the microphones M1 and M2 at different points of time and with different volumes and phase differences. Especially, when the microphones M1 and M2 are mounted in the headphone HP, even if the speaker U moves, the specific audio source Ss is located at substantially equal distances from the microphones M1 and M2, and therefore, the specific audio Vs and the unspecific audio Vn can be easily discriminated from each other.

The phase difference $\Delta\theta$ between audios V picked up by the microphones M1 and M2 is calculated using FIG. 2. Distances SM1 and SM2 between an audio source S and the microphones M1 and M2 are obtained from the following formula:

$$SM1=\sqrt{((L\cdot\tan\alpha+d)^2+L^2)}$$

$$SM2=\sqrt{((L\cdot\tan\alpha-d)^2+L^2)},$$

wherein d is ½ of the distance between the microphones M1 and M2, L is a vertical distance between the audio source S and the microphone array, and $\alpha$ is an angle formed by the audio source S and the center of the microphone array.

Thus, the phase difference $\Delta\theta$ between the audios V picked up by the microphones M1 and M2 is obtained by the following formula:

$$\Delta\theta=2\pi f\cdot(SM1-SM2)/c,$$

wherein c is an audio speed (342 m/s), and f is a frequency of audio (Hz).

In the beamforming, while the specific audio Vs is maintained based on, for example, the phase difference $\Delta\theta$ between the audios V picked up by the microphones M1 and M2, the unspecific audio Vn is reduced, whereby the specific audio Vs can be selectively input as a transmitted audio.

The audio V picked up by the microphones M1 and M2 is determined as the specific audio Vs or the unspecific audio Vn by comparing the phase difference $\Delta\theta$ between the audios V with a threshold value $\theta t$. For example, in a case where d is 5 cm, L is 100 cm, and f is 800 Hz, when the phase difference $\Delta\theta=42°$ is the threshold value $\theta t$, the audio V less than the threshold value $\theta t$ is determined as the specific audio Vs, and the audio V not less than the threshold value $\theta t$ is determined as the unspecific audio Vn. The threshold value $\theta t$ used in the determination differs according to the conditions of d, L, and the like. In the threshold value $\theta t$, although the absolute value is defined as a positive or negative value with the same absolute value, $|\Delta\theta|<\theta t$ is hereinafter referred to as less than the threshold value $\theta t$, and $\theta t\leq|\Delta\theta|$ is hereinafter referred to as not less than the threshold value $\theta t$.

[2. Constitution of Information Processing Apparatus 100]

Figure 3:
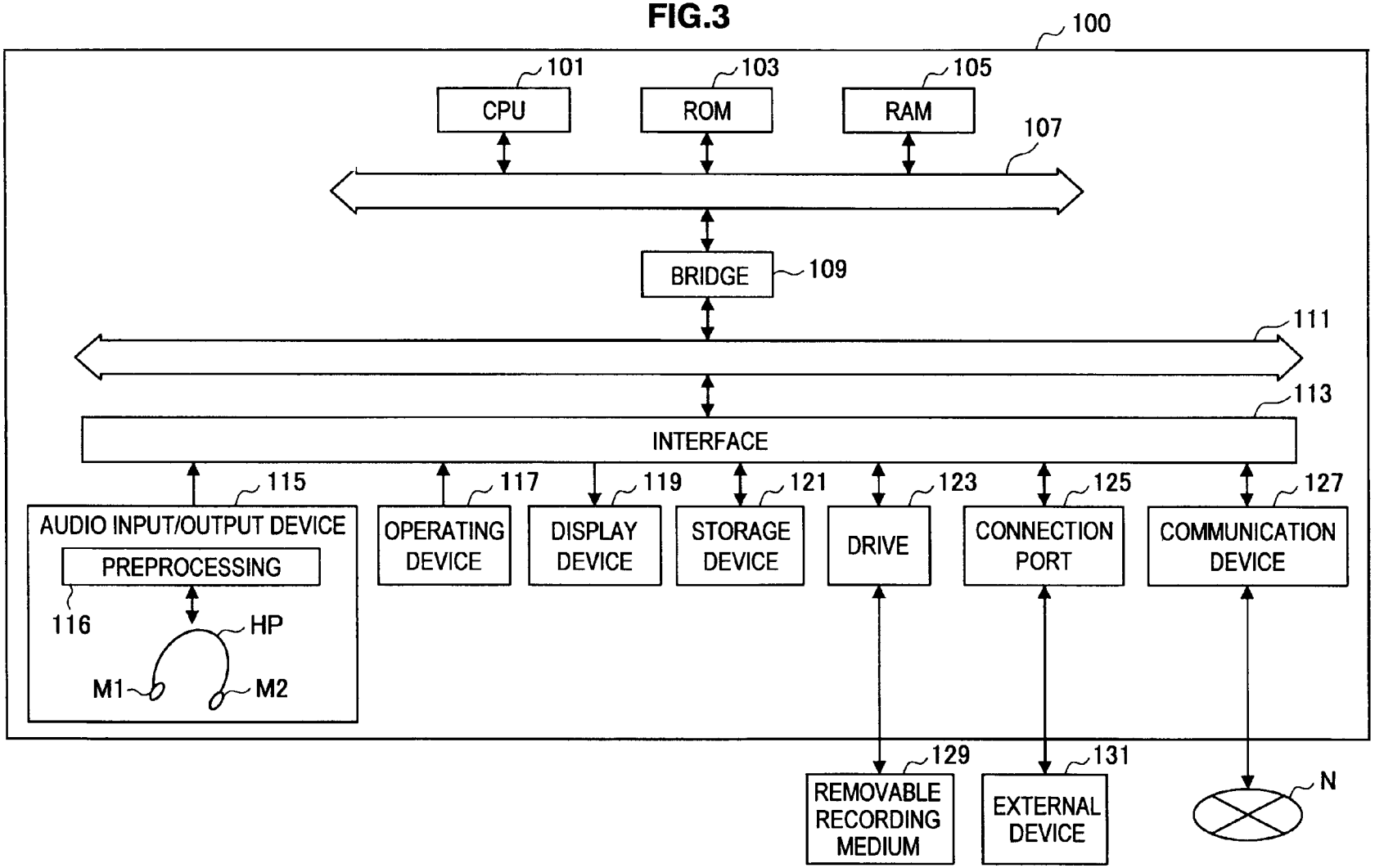
FIG. 3 is a view showing a main hardware configuration of an information processing apparatus.
Figure 4:
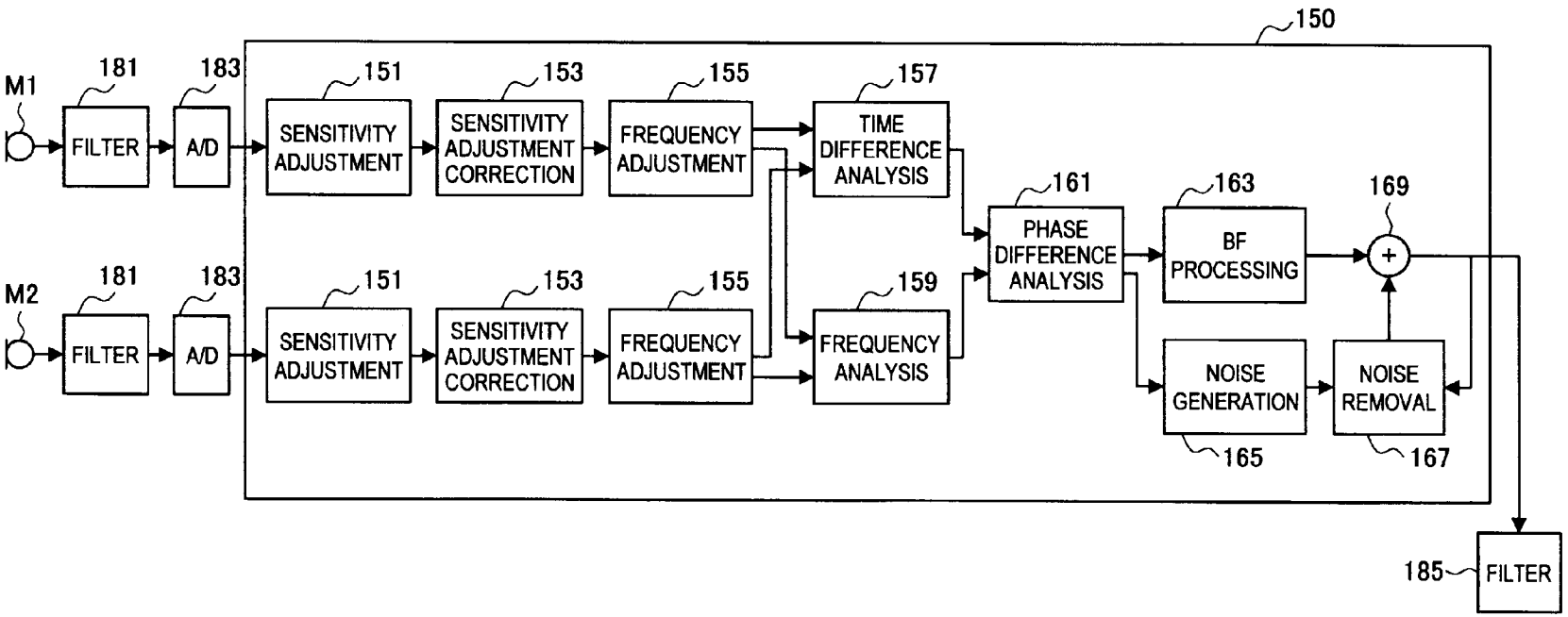
FIG. 4 is a view showing a main functional configuration of an audio signal processing unit.

Next, the information processing apparatus 100 according to an embodiment of the present invention will be described with reference to FIGS. 3 and 4. FIG. 3 is a view showing a main hardware configuration of the information processing apparatus 100. FIG. 4 is a view showing a main functional configuration of an audio signal processing unit 150.

As shown in FIG. 3, although the information processing apparatus 100 is, for example, a personal computer, a PDA, a game machine, and a cell phone, it is hereinafter assumed that a case where the information processing apparatus 100 is a personal computer.

The information processing apparatus 100 is mainly constituted of a CPU 101, a ROM 103, a RAM 105, a host bus 107, a bridge 109, an external bus 111, an interface 113, an audio input/output device 115, an operating device 117, a display device 119, a storage device 121, a drive 123, a connection port 125, and a communication device 127.

The CPU 101 is operated as a calculation processor and a controller and controls at least partially the operation of the information processing apparatus 100 in accordance with various programs recorded in the ROM 103, the RAM 105, the storage device 121, or a removable recording medium 129. The CPU 101 is also operated as a parameter setting unit which sets a processing parameter specifying the processing conditions of an audio signal according to at least an instruction from a user. The ROM 103 stores programs and parameters used by the CPU 101. The RAM 105 temporarily stores programs executed by the CPU 101 and parameters in the execution of the programs.

The CPU 101, the ROM 103, and the RAM 105 are connected to each other through the host bus 107. The host bus 107 is connected to the external bus 111 through the bridge 109.

The audio input/output device 115 is input/output means that includes the headphone HP, microphones, and a speaker and can input and output the audio signal. The audio input/output device 115 includes a preprocessing unit 116 such as various filters 181 and 185, an A/D convertor 183, a D/A converter (not shown) (see, FIG. 4). Especially, in the audio input/output device 115 according to the present embodiment, a pair of microphones M1 and M2 are provided respectively in the left and right units of the headphone HP. The audio input/output device 115 supplies an external audio signal, picked up by the microphones M1 and M2, to the audio signal processing unit 150 and supplies the audio signal, processed by the audio signal processing unit 150, to the headphone HP.

The operating device 117 is user operable operating means such as a mouse, a keyboard, a touch panel, a button, and a switch. For example, the operating device 117 is constituted of an input control circuit which generates an input signal based on operation information input by a user using the operating means and outputs the input signal to the CPU 101. The user inputs various data to the information processing apparatus 100 through the operation of the operation device 117 to instruct a processing operation.

The display device 119 is display means such as a liquid crystal display. The display device 119 outputs a processing result by the information processing apparatus 100. For example, the display device 119 displays, as text information or image information, the processing result by the information processing apparatus 100 including an after-mentioned setting panel CP for various parameter setting.

The storage device 121 is a device for use in data storage and includes, for example, a magnetic storage device such as an HDD. The storage device 121 stores, for example, programs executed by the CPU 101, various data, and externally input various data.

The drive 123 is a reader/writer for recording media and is built in or externally attached to the information processing apparatus 100. The drive 123 reads recorded data from the removable recording medium 129 such as a magnetic disk loaded therein to output the data to the RAM 105 and writes data to be recorded to the removable recording medium 129.

The connection port 125 is a port for use in directly connecting an external device 131 to the information processing apparatus 100, such as a USB port. The information processing apparatus 100 obtains data from the external device 131, connected to the connection port 125, through the connection port 125 and provides data to the external device 131.

The communication device 127 is the communication interface 113 constituted of, for example, a communication device for use in connection to a communication network N. The communication device 127 is a communication card for a wired or wireless LAN, for example. The communication network N connected to the communication device 127 is constituted of, for example, a wired or wirelessly connected network.

[3. Constitution of Audio Signal Processing Unit 150]

As shown in FIG. 4, the information processing apparatus 100 includes the audio signal processing unit 150 that processes the audio signals from the microphones M1 and M2. The audio signal processing unit 150 is realized by hardware or software, or a combination of both. FIG. 4 shows only the constitution for use in performing audio input processing associated with the present invention.

The audio signal processing unit 150 includes a sensitivity adjustment unit 151, a sensitivity adjustment correction unit 153, and a frequency adjustment unit 155 for each input system of the microphones M1 and M2. The audio signal processing unit 150 further includes a time difference analysis unit 157, a frequency analysis unit 159, a phase difference analysis unit 161, a beamforming processing unit 163 (also referred to as a BF processing unit 163), a noise generation unit 165, a noise removal unit 167, and an adder 169 at the post stages of the input systems of the microphones M1 and M2. When noise removal processing is not performed, the noise generation unit 165, the noise removal unit 167, and the adder 169 may be omitted.

The microphones M1 and M2 pick up external audio to convert the audio into an analogue audio signal, and, thus, to supply the audio signal to the preprocessing unit 116. In the preprocessing unit 116, the audio signals from the microphones M1 and M2 are input to the filter 181. The filter 181 filters the audio signal to obtain a predetermined signal component included in the audio signal, and, thus, to supply the signal component to the A/D converter 183. The A/D converter 183 performs PCM conversion of the audio signal after filtering into a digital audio signal (audio data) to supply the audio data to the audio signal processing unit 150.

In the audio signal processing unit 150, signal processing is applied by the sensitivity adjustment unit 151, the sensitivity adjustment correction unit 153, and the frequency adjustment unit 155 for each input system of the microphones M1 and M2, and the audio signal is supplied to the time difference analysis unit 157 and the frequency analysis unit 159. The signal processing by the sensitivity adjustment unit 151, the sensitivity adjustment correction unit 153, and the frequency adjustment unit 155 will be described in detail later.

The time difference analysis unit 157 analyzes the time difference between the audios reaching the microphones M1 and M2 based on the audio signal supplied from each input system. The audio reaching time difference is analyzed for time series of the audio signals from the microphones M1 and M2 by performing cross-correlation analysis based on phase changes and level changes, for example.

The frequency analysis unit 159 analyzes the frequency of the audio signal based on the audio signal supplied from each input system. In the frequency analysis, the time series of the audio signal are decomposed into sine wave signals with various periods and amplitudes, using FFT (Fast Fourier transform) or the like, and a frequency spectrum of the audio signal is analyzed.

The phase difference analysis unit 161 analyzes the phase difference $\Delta\theta$ between the audios picked up by the microphones M1 and M2 based on the results of the time difference analysis and the frequency analysis. In the phase difference analysis, the phase difference $\Delta\theta$ between audios is analyzed for each frequency component. By virtue of the phase difference analysis, the phase difference $\Delta\theta$ for each frequency component is compared with a predetermined threshold value $\theta t$, and the frequency component with not less than the threshold value $\theta t$ is determined as a noise component (unspecific audio Vn).

The BF processing unit 163 applies beamforming processing to the audio signal input from each input system based on the result of the phase difference analysis to supply the audio signal to the adder 169. In the beamforming processing, when the phase difference $\Delta\theta$ between the audios picked up by the microphones M1 and M2 is less than the threshold value $\theta t$, the signal level is kept, and when the phase difference $\Delta\theta$ is not less than the threshold value $\theta t$, the signal level is reduced.

According to the above constitution, in the specific audio Vs, the position at substantially equal distances from the microphones M1 and M2 is the audio source Ss of the specific audio Vs, and the phase difference $\Delta\theta$ is small; therefore, the signal level is kept. Meanwhile, in the unspecific audio Vn, the position at different distances from the microphones M1 and M2 is generally the audio source Sn of the unspecific audio Vn, and the phase difference $\Delta\theta$ is large; therefore, the signal level is reduced.

Based on the result of the phase difference analysis, the noise generation unit 165 generates a noise signal representing noise (the unspecific audio Vn) included in the audio picked up by the microphones M1 and M2.

The noise removal unit 167 generates a signal represented by inverting the noise signal to supply the generated signal to the adder 169 for the purpose of removing a signal component corresponding to the unspecific audio Vn. The noise removal unit 167 receives feedback of the audio signal after addition processing to adapt the noise signal to a feedback signal.

The adder 169 sums the audio signal supplied from the BF processing unit 163 and the signal supplied from the noise removal unit 167 to supply the sum to the filter 185. According to this constitution, the noise component is removed from the audio signal after BF processing, and the specific audio is further selectively input. The audio signal after summing is input as the transmitted audio through the post-stage of the filter 185 to be transmitted, by the communication device 127, to a reproducing apparatus 100' (not shown) through the communication network N, and, thus, to be reproduced by the reproducing apparatus 100'.

[4. Setting Processing of Processing Parameters]

Figure 5:
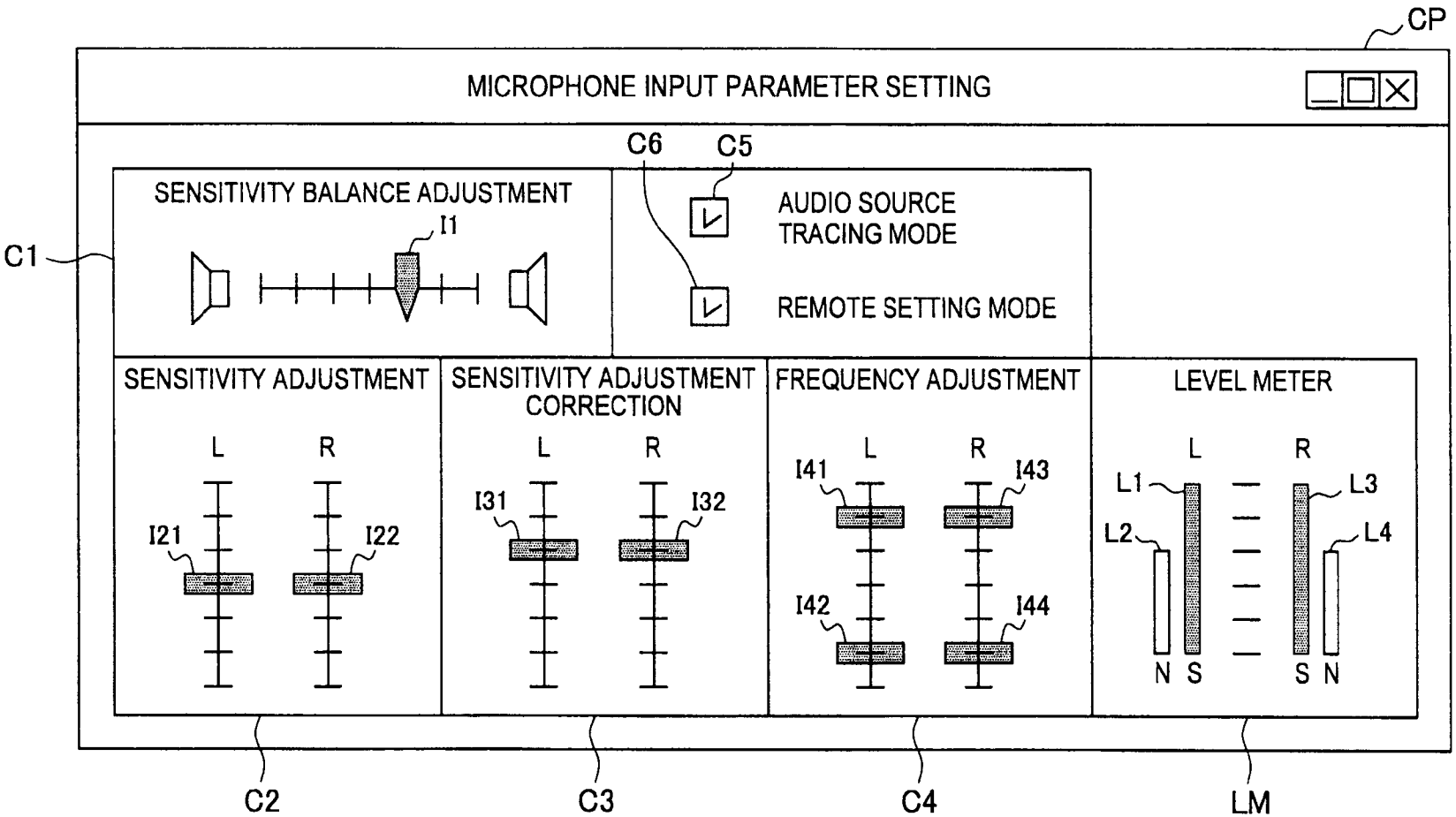
FIG. 5 is a view showing a setting panel for processing parameter setting.
Figure 6A:
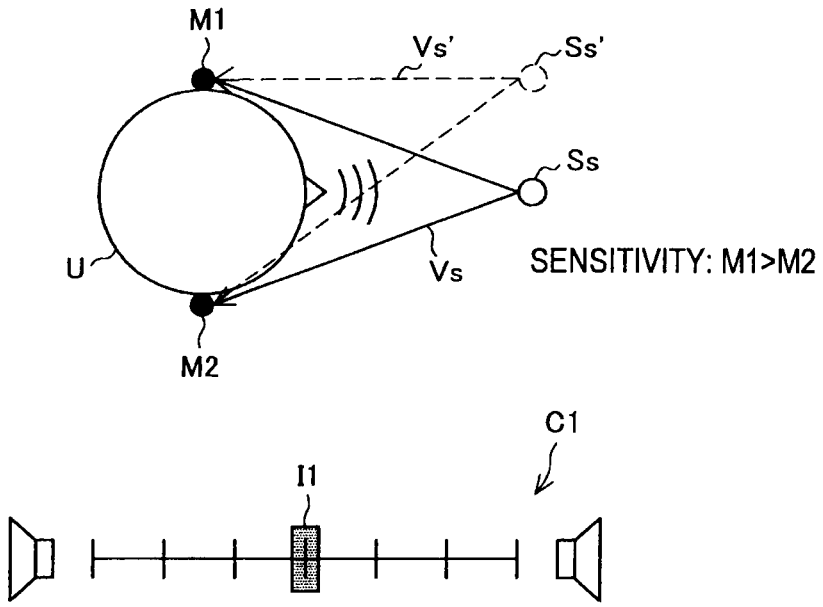
FIG. 6A is a view (1/2) for explaining a setting processing of sensitivity balance adjustment.
Figure 6B:
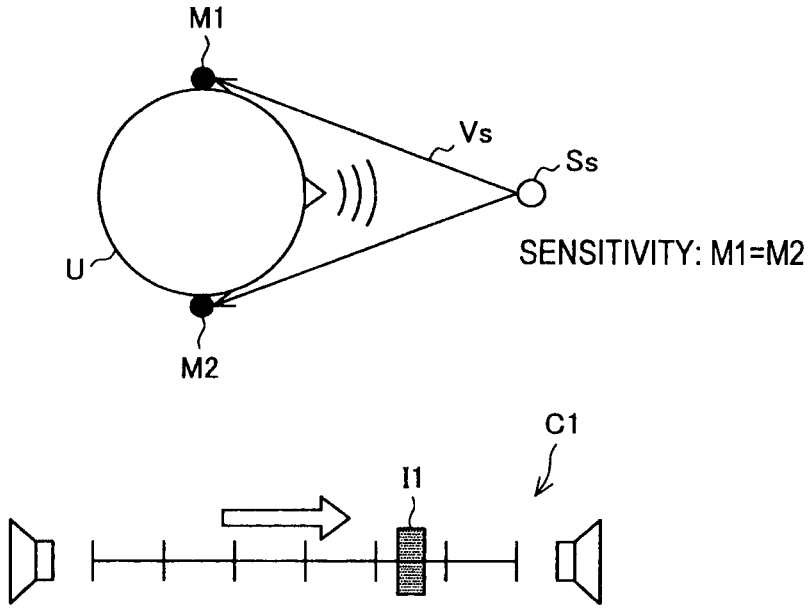
FIG. 6B is a view (2/2) for explaining a setting processing of sensitivity balance adjustment.
Figure 7A:
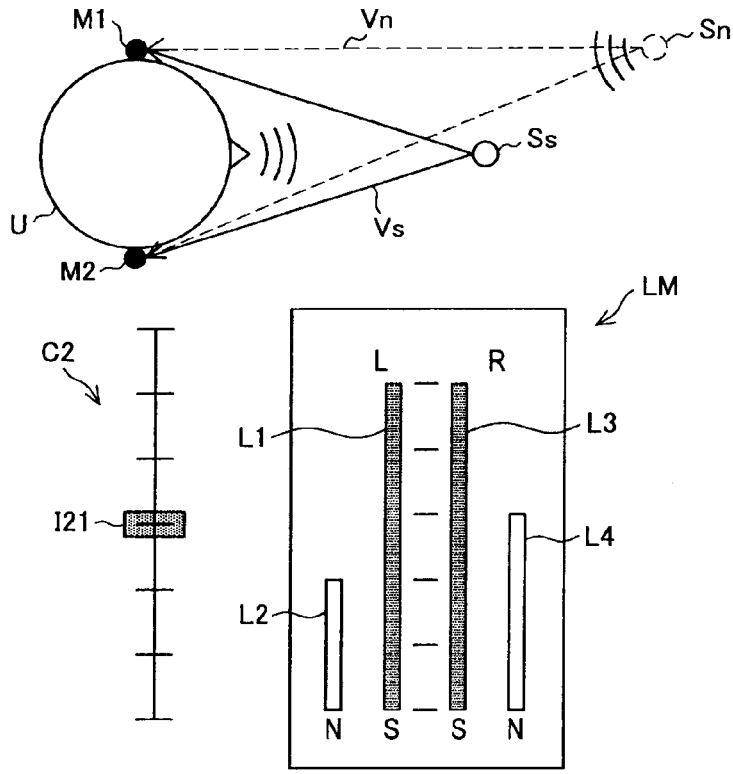
FIG. 7A is a view (1/2) for explaining a setting processing of sensitivity adjustment.
Figure 7B:
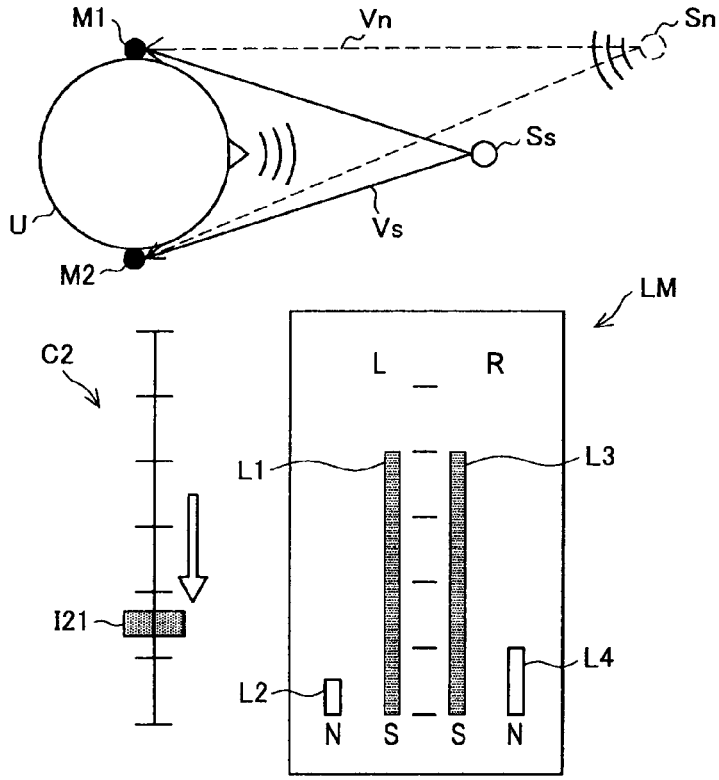
FIG. 7B is a view (2/2) for explaining a setting processing of sensitivity adjustment.
Figure 8A:
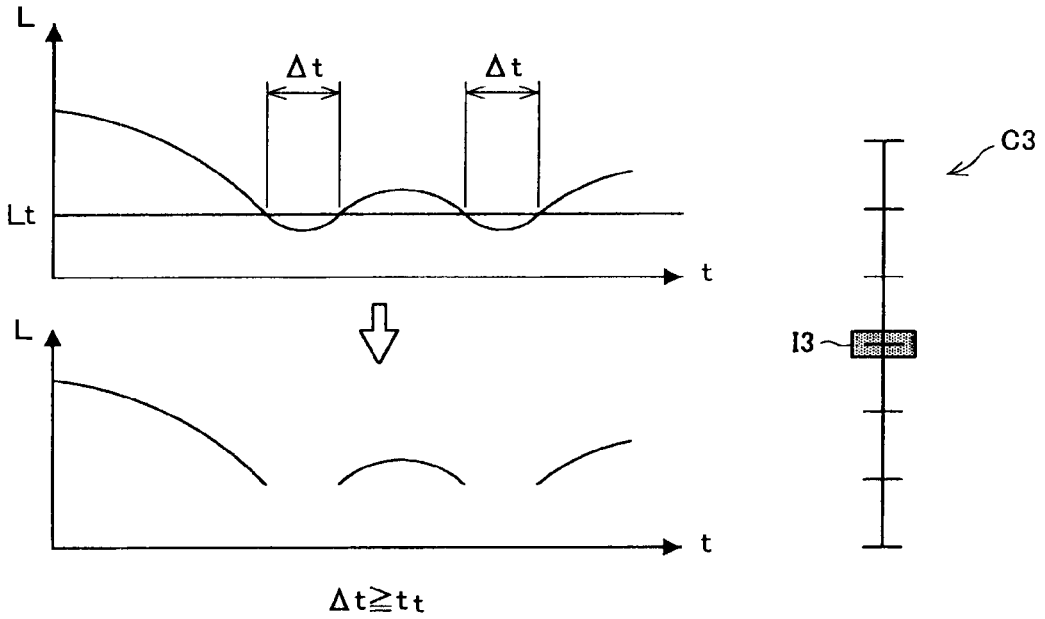
FIG. 8A is a view (1/2) for explaining a setting processing of sensitivity adjustment correction.
Figure 8B:
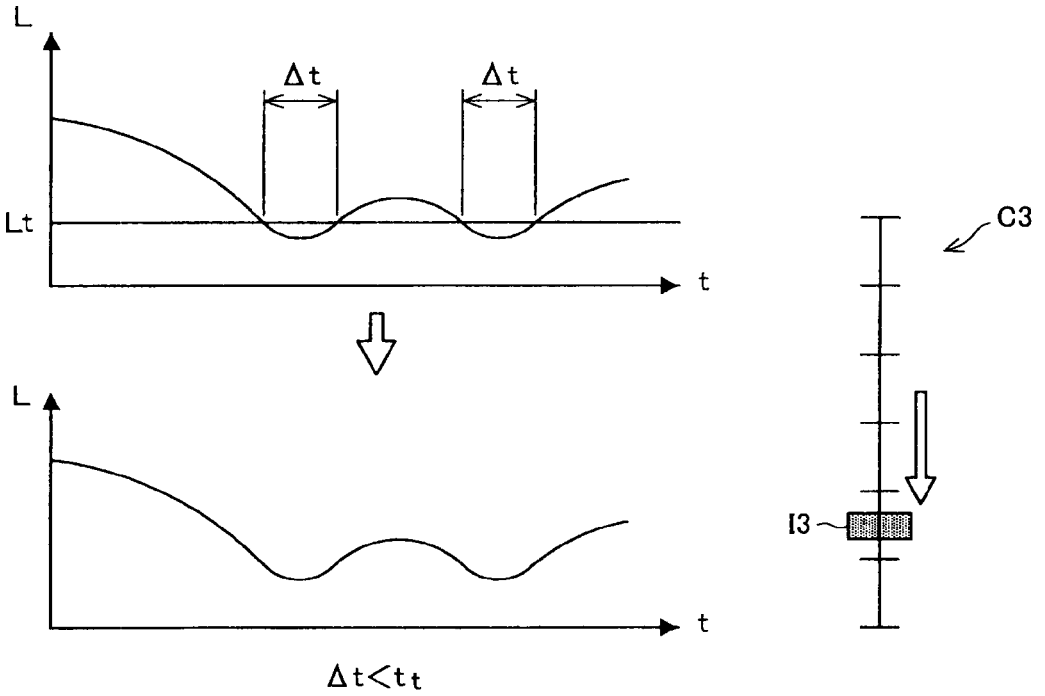
FIG. 8B is a view (2/2) for explaining a setting processing of sensitivity adjustment correction.
Figure 9:
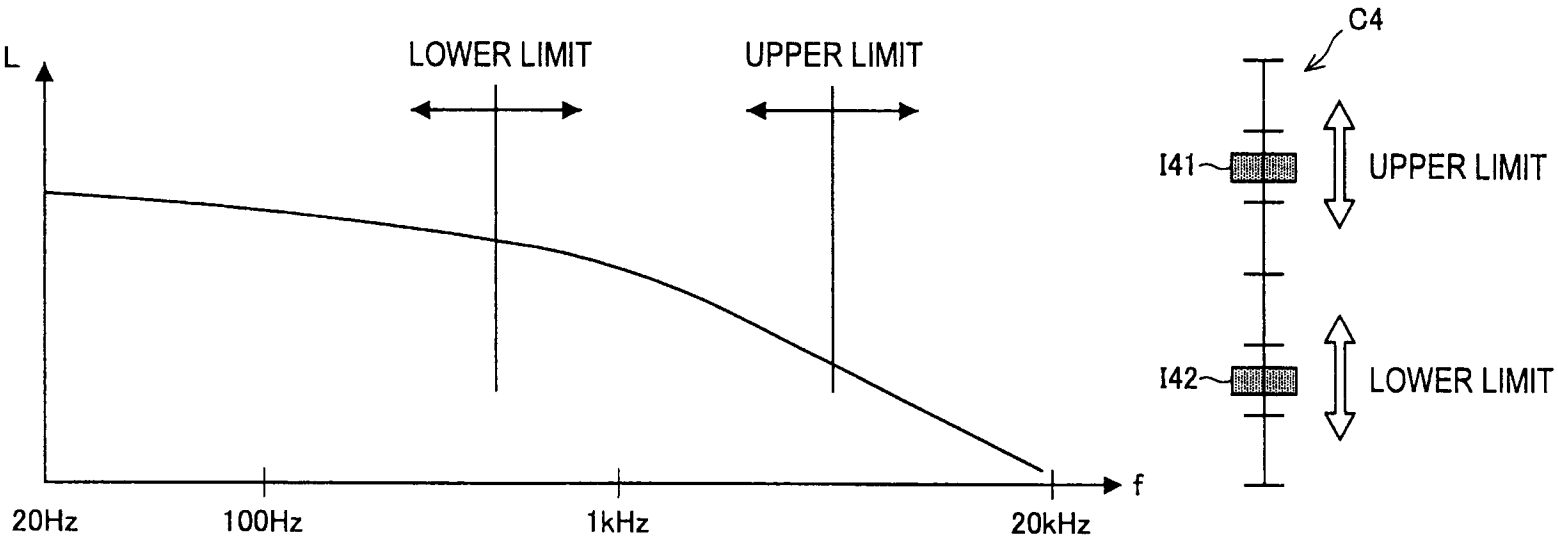
FIG. 9 is a view for explaining a setting processing of frequency adjustment.
Figure 10A:
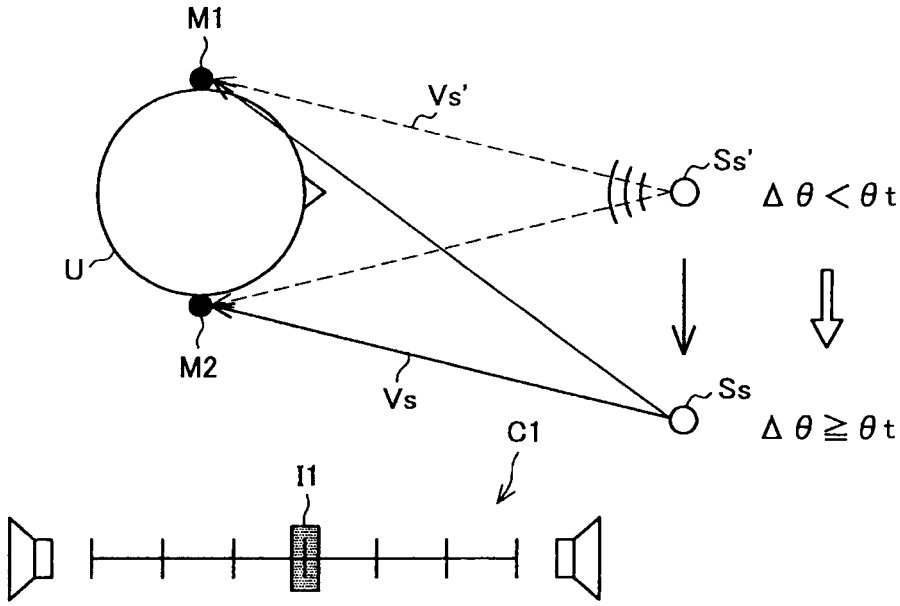
FIG. 10A is a view (1/2) for explaining a tracing processing of a specific audio source.
Figure 10B:
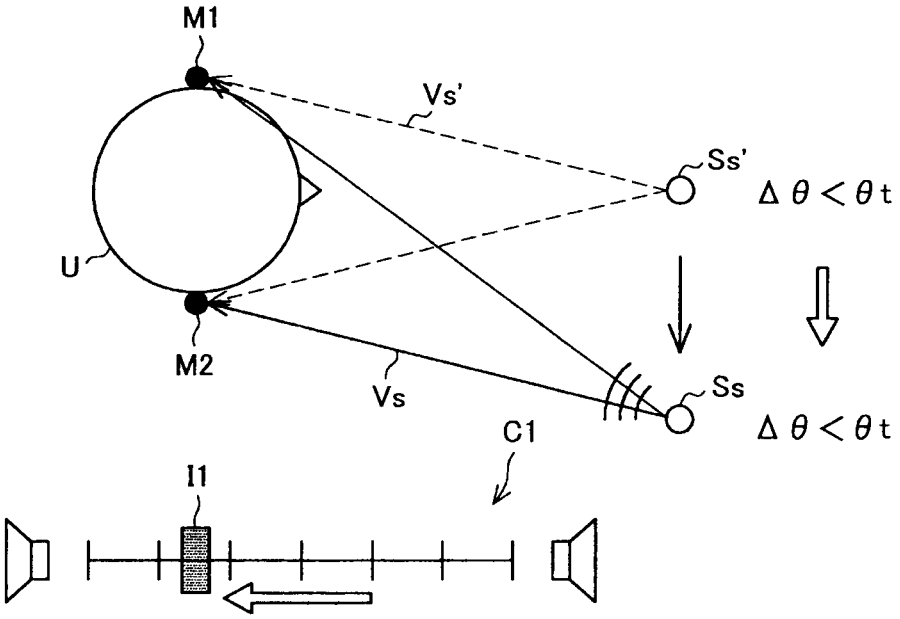
FIG. 10B is a view (2/2) for explaining a tracing processing of a specific audio source.
Figure 11:
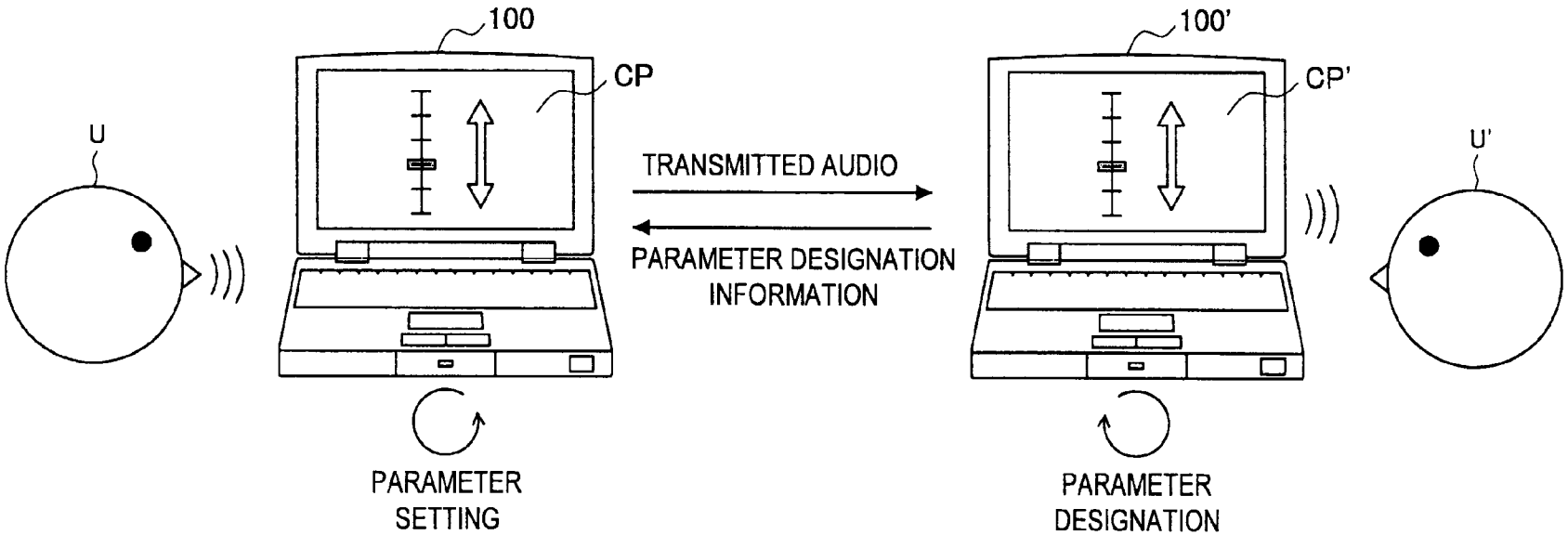
FIG. 11 is a view for explaining a remote setting processing of a processing parameter.

Next, a setting processing of processing parameters will be described with reference to FIGS. 5 to 11. FIG. 5 is a view showing the setting panel CP for processing parameter setting. FIGS. 6A and 6B are views for explaining a setting processing of sensitivity balance adjustment. FIGS. 7A and 7B are views for explaining a setting processing of sensitivity adjustment. FIGS. 8A and 8B are views for explaining a setting processing of sensitivity adjustment correction. FIG. 9 is a view for explaining a setting processing of frequency adjustment. FIGS. 10A and 10B are views for explaining a tracing processing of the specific audio source Ss. FIG. 11 is a view for explaining a remote setting processing of the processing parameter.

In the setting of the processing parameter, the CPU 101 executes a program to thereby make the display device 119 display the setting panel CP as shown in FIG. 5. The setting panel CP displays thereon sliders C1, C2, C3, and C4 for use in setting each parameter of the sensitivity balance adjustment, the sensitivity adjustment, the sensitivity adjustment correction, and the frequency adjustment. The setting panel CP further displays thereon switches C5 and C6 for use in switching validity/invalidity of the audio source tracing processing and the remote setting processing and a level meter LM. The setting panel CP may display operation icons other than sliders and switches.

In the slider C1 for sensitivity balance adjustment, the parameter is set by operation of a knob I1. In the sliders C2, C3, and C4 for use in the sensitivity adjustment, the sensitivity adjustment correction, and the frequency adjustment, each parameter is set for each of the microphones M1 and M2 by operation of knobs I21, I22, I31, I32, I41, I42, I43, and I44. The sliders C2, C3, and C4 for use, respectively, in the sensitivity adjustment, the sensitivity adjustment correction, and the frequency adjustment may not be provided for each of the microphones M1 and M2 but may be commonly provided for both the microphones M1 and M2. In the level meter LM, signal levels L1 to L4 of the specific audio Vs and the unspecific audio Vn are displayed for each of the microphones M1 and M2.

The speaker U displays the setting panel CP by performing a predetermined operation to operate the sliders C1 to C4 and the switches C5 and C6 on the setting panel CP, and, thus, to enable setting of each parameter and mode.

[4-1. Sensitivity Balance Adjustment Processing]

Based on the sensitivity balance adjustment parameter, the sensitivity adjustment unit 151 changes the level balance between the signals from the microphones M1 and M2 and adjusts the sensitivity balance between the microphones M1 and M2.

It is noted that a variation of about +/−3 dB occurs in the sensitivities of the wearable microphones M1 and M2, depending on manufacturing conditions. For example, it is assumed that there is used an algorithm enhancing the specified accuracy at an audio source position using a parameter of a volume difference. In this case, when there is a sensitivity difference between the microphones M1 and M2, a difference occurs between the volumes of the audios picked up by the microphones M1 and M2, the audio from the audio source located in front of the speaker U is picked up as the audio from the audio source located deviating from the front of the speaker U. Although it is considered that the microphones M1 and M2 with the same sensitivity are used, manufacturing yield of components of a microphone is lowered, leading to increase in cost.

For example, as shown in FIG. 6A, when the sensitivity of the microphone M1 is higher than the sensitivity of the microphone M2, the signal level of the microphone M1 is relatively higher. Thus, for example, the specific audio Vs from the audio source Ss located in front of the speaker U is picked up as audio Vs' from an audio source Ss' located on the microphone M1 side. The audio from the specific audio source Ss is heard as the audio Vs' from the audio source Ss' by a receiver U'.

In the above case, as shown in FIG. 6B, the slider C1 for use in sensitivity balance adjustment is used, the sensitivity balance adjustment parameter is set so that the level balance between the signals from the microphones M1 and M2 is shifted toward the microphone M2. The shifting of the level balance is realized by an increase in the signal level of the microphone M2, a decrease in the signal level of the microphone M1, or a combination of both (for example, such a combination that prevents the sum of the signal levels of the microphones M1 and M2 from changing before and after adjustment). For example, when the signal level of the microphone M2 is increased, the signal level of the microphone M2 is multiplied by a predetermined increase rate, and the signal level difference is reduced between the microphones M1 and M2. According to this constitution, regardless of a variation in the sensitivity balance, the audio from the specific audio source Ss can be input as the audio from the audio source located in front of the speaker U.

[4-2. Sensitivity Adjustment Processing]

Based on the sensitivity adjustment parameter, the sensitivity adjustment unit 151 changes the signal levels of the microphones M1 and M2 and adjusts the sensitivities of the microphones M1 and M2. When the sensitivity of the microphone is increased, although the audio from the audio source away from the microphone can be input, the unspecific audio Vn is easily input. Meanwhile, when the sensitivity of the microphone is reduced, only the audio from the audio source near the microphone can be input, and the specific audio Vs is easy to be selectively input.

In the sensitivity adjustment, with regard to the specific audio Vs and the unspecific audio Vn, the level meter LM which displays the signal level in real time is utilized. The level meter LM is realized by displaying the frequency-analyzed signal level in real time. Since in general the transmitted audio is reproduced only on the receiver U' side, the speaker U may not easily confirm the result of the sensitivity adjustment. However, by virtue of the use of the level meter LM, the input conditions of the specific audio Vs and the unspecific audio Vn can be confirmed, and the sensitive adjustment can be easily performed.

In the example shown in FIG. 7A, since the sensitivities of the microphones M1 and M2 are high, both the specific audio Vs and the unspecific audio Vn are considerably input. In this case, the speaker U can confirm the input conditions of the audio (L1, L3: the input conditions of Vs, and L2, L4: the input conditions of Vn) through the level meter LM.

In the above case, as shown in FIG. 7B, the slider C2 for sensitivity adjustment is used, and the sensitivity adjustment parameter is set so that the sensitivities of the microphones M1 and M2 are reduced (in FIGS. 7A and 7B, only the slider of the microphone M1 is shown). Then, the signal levels of the microphones M1 and M2 are multiplied by a predetermined reduction rate according to the setting of the sensitivity adjustment parameter, and the signal levels of the microphones M1 and M2 are reduced. The speaker U properly adjusts the sensitivity of the microphones while confirming the input conditions of audio through the level meter LM to thereby enable to selectively input the specific audio Vs in good condition.

[4-3. Sensitivity Adjustment Correction Processing]

Based on the sensitivity adjustment correction parameter, the sensitivity adjustment correction unit 153 corrects the sensitivity adjustment for the microphones M1 and M2. When the signal level is continuously less than the predetermined threshold value Lt, the sensitivity adjustment correction parameter is a parameter showing a duration tt till when the input of the audio signal is discontinued. The predetermined threshold value Lt is set according to the results of the sensitivity adjustment for the microphones M1 and M2.

The speaking voice is not continued with a constant volume. Thus, when the volume of the specific audio Vs is temporarily reduced, audio with a low volume is not input, and the specific audio Vs is intermittently input. However, if the sensitivity of the microphone is too high, the unspecific audio Vn with a low volume is also input, and thus a signal/noise ratio (S/N) is reduced.

Thus, when the signal level less than the predetermined threshold value Lt is detected, the sensitivity adjustment correction unit 153 starts to determine whether or not the input of the audio signal is discontinued. When the signal level less than the predetermined threshold value Lt is detected over a determination time tt, the input of the audio signal is discontinued. Meanwhile, when the signal level not less than the predetermined threshold value Lt is detected again within the determination time tt, the determination time tt is initialized to continue the input of the audio signal.

In the example shown in FIG. 8A, the signal level fluctuates vertically with the predetermined threshold value Lt as a border. Further, a section length Δt where the signal level is less than the threshold value Lt is not less than the duration tt. Thus, the audio signal in a section where the signal level is less than the threshold value Lt is not less than the duration tt is not input, and the specific audio Vs is intermittently input.

In the above case, as shown in FIG. 8B, the slider C3 for sensitivity adjustment correction is used, and the sensitivity adjustment correction parameter is set so that the duration tt is increased (in FIGS. 8A and 8B, only the slider of the microphone M1 is shown). According to this constitution, the audio signal in the section where the signal level is less than the threshold value Lt is input, and the specific audio Vs can be continuously input.

[4-4. Frequency Adjustment Processing]

Based on the frequency adjustment parameter, the frequency adjustment unit 155 adjusts the frequency range of the audio signal input from each of the microphones M1 and M2. In a fixed-line phone, the frequency band of the speaking voice of about 300 to 3400 Hz is utilized. Meanwhile, it is widely known that the frequency band of an environmental sound (noise) is wider than the frequency band of the speaking voice.

Thus, as shown in FIG. 9, the slider C4 for frequency adjustment is used, and the frequency range of the input audio signal is set. The frequency range is set by operating tabs 141 and 142 showing respectively the upper and lower limits of the frequency range (in FIG. 9, only the slider of the microphone M1 is shown). Based on the set frequency range, the frequency adjustment unit 155 filters the audio signal to obtain a predetermined signal component included in the audio signal, and, thus, to supply the signal component to the post stage. According to this constitution, the specific audio Vs can be selectively input in good condition.

[4-5. Audio Source Tracing Processing]

In the audio source tracing processing, the sensitivity balance adjustment parameter is automatically set so as to follow a relative positional change between the microphones M1 and M2 and the specific audio source Ss. The sensitivity balance is adjusted so that the volume of the specific audio Vs is highest, that is, the phase difference Δθ between the audios from the microphones M1 and M2 is less than the threshold value θt. According to this constitution, the picking-up of the specific audio Vs can be continued, and it is possible to trace the specific audio source Ss.

For example, in the example shown in FIG. 10A, the specific audio source Ss' of a conversational partner of the speaker U is located in front of the speaker U, and the phase difference Δθ between the audios from the microphones M1 and M2 is less than the threshold value θt. Therefore, the specific audio Vs is maintained, and the unspecific audio Vn (not shown) is reduced to be input. However, the audio source is significantly moved toward the microphone M2 to become the specific audio source Ss, and when the phase difference Δθ is not less than the threshold value θt, the specific audio Vs is reduced, so that the specific audio Vs may not be input.

Thus, as shown in FIG. 10B, the sensitivity balance is automatically adjusted so that the level balance between the signals from the microphones M1 and M2 is shifted toward the microphone M2. The sensitivity balance is adjusted so that the phase difference Δθ between the audios from the microphones M1 and M2 is less than the threshold value θt, following the relative positional change between the microphones M1 and M2 and the specific audio source Ss. According to this constitution, even if the relative position between the speaker U and the specific audio source Ss is changed, the specific audio Vs can be continuously input.

[4-6. Remote Setting Processing]

In the remote setting processing, the receiver U' can remotely set various parameters. For example, the receiver U' remotely sets various parameters, using a setting panel CP' similar to the setting panel CP of FIG. 5.

For example, as shown in FIG. 11, when the reproducing apparatus 100' reproduces the transmitted voice of the speaker U, the receiver U' designates (sets) various parameters on the setting panel CP' according to the quality of the reproduced voice. The reproducing apparatus 100' transmits parameter designation information to the information processing apparatus 100 through the communication network N in response to the operation of the receiver U'. The information processing apparatus 100 sets various parameters based on the parameter designation information to reflect the setting conditions to the setting panel CP. According to this constitution, the setting of the parameters is optimized, whereby the quality of the transmitted voice can be further enhanced between the speaker U and the receiver U'.

[5. Conclusion]

As described above, according to the above embodiment, based on the processing parameter that specifies at least the sensitivities of the microphones M1 and M2 and is set according to at least an instruction from a user, the audio processing including the beamforming processing is applied to external audio signals picked up by the microphones M1 and M2 provided as at least a pair. According to this constitution, the processing parameter specifying at least the sensitivity of a pick-up unit is set according to a usage environment, whereby the specific audio Vs can be selectively input in good condition, and the quality of the transmitted audio can be enhanced.

It should be understood by those skilled in the art that various modifications, combinations, sub-combinations and alterations may occur depending on design requirements and other factors insofar as they are within the scope of the appended claims or the equivalents thereof.

For example, in the description of the above embodiment, the processing parameter is set according to a usage environment, whereby the level of the audio signal of the specific audio Vs is maintained, and the level of the audio signal of the unspecific audio Vn is reduced. However, the level of the audio signal of the specific audio Vs is reduced, and the level of the audio signal of the unspecific audio Vn may be maintained. According to this constitution, the unspecific audio Vn can be selectively input in good condition, and the sound around a speaker can be clearly heard.

The present application contains subject matter related to that disclosed in Japanese Priority Patent Application JP 2009-207985 filed in the Japan Patent Office on Sep. 9, 2009, the entire content of which is hereby incorporated by reference.

What is claimed is:

1. An information processing apparatus comprising:

at least two pick-up circuits to pick up external audio and to convert the external audio into an audio signal; and circuitry configured to set a processing parameter specifying at least a sensitivity balance between each of the at least two pick-up circuits according to at least an instruction received from a user via a single slider button, display a level meter for each of the pick-up circuits to indicate a sensitivity thereof in real-time, and apply processing including beamforming processing to the audio signal, input from the pick-up circuits, based on the processing parameter.

2. The information processing apparatus according to claim 1, wherein the circuitry adjusts the sensitivity balance between the at least two pick-up circuits based on the processing parameter.

3. The information processing apparatus according to claim 1, wherein when the level of the audio signal input from the at least two pick-up circuits is continuously less than a predetermined threshold value, the circuitry adjusts a duration until when the input of the audio signal is discontinued, based on the processing parameter.

4. The information processing apparatus according to claim 1, wherein the circuitry adjusts a frequency range of the audio signal, input from the at least two pick-up circuits, based on the processing parameter.

5. The information processing apparatus according to claim 1, wherein a sensitivity balance between the at least two pick-up circuits is automatically set so that the level of the audio signal corresponding to a specific audio source is highest, following a relative positional change between the at least two pick-up circuits and the specific audio source.

6. The information processing apparatus according to claim 1, wherein the circuitry is further configured to:

transmits the audio signal subjected to the audio processing to a reproducing apparatus through a communication network, receive parameter designation information, designating the processing parameter, from the reproducing apparatus, and set the processing parameter in accordance with the received parameter designation information.

7. The information processing apparatus according to claim 1, wherein the circuitry maintains the level of the audio signal when a phase difference between the audio signals input from the at least two pick-up circuits is less than a predetermined threshold value, and reduces the level of the audio signal when the phase difference is not less than the predetermined threshold value.

8. The information processing apparatus according to claim 1, wherein the circuitry synthesizes a signal, which is for use in removal of signals other than the audio signal corresponding to other than a specific audio source of the audio signals input from the pick-up circuits, with the audio signal input from the at least two pick-up circuits.

9. The information processing apparatus according to claim 1, wherein the at least two pick-up circuits are provided respectively in left and right units of a headphone.

10. The information processing apparatus according to claim 1, wherein the circuitry adjusts the processing parameter according to an instruction from a user input through a setting screen, including the single slider button, for use in setting the processing parameter.

11. An information processing method, comprising:

setting a processing parameter specifying a sensitivity balance between at least two pick-up units that pick up external audio and convert the external audio into an audio signal, according to at least an instruction received from a user via a single slider button;

displaying a level meter for each of the pick-up circuits to indicate a sensitivity thereof in real-time; and applying audio processing, including beamforming processing, to the audio signal based on the processing parameter.

12. A non-transitory computer-readable medium storing computer-readable instructions thereon, the computer-readable instructions when executed by a computer cause the computer to perform a method comprising:

setting a processing parameter specifying a sensitivity balance between at least two pick-up units that pick up external audio and convert the external audio into an audio signal, according to at least an instruction received from a user via a single slider button;

displaying a level meter for each of the pick-up circuits to indicate a sensitivity thereof in real-time; and applying audio processing, including beamforming processing, to the audio signal based on the processing parameter.

* * * * *